US006476543B1

(12) United States Patent
Mera et al.

(10) Patent No.: US 6,476,543 B1
(45) Date of Patent: Nov. 5, 2002

(54) CATHODE RAY TUBE HAVING AN IMPROVED ELECTRODE ASSEMBLY

(75) Inventors: Takeshi Mera, Mobara (JP); Yoshifumi Konishi, Mobara (JP); Ken Kagabu, Chousei (JP); Akihito Sudo, Mobara (JP)

(73) Assignees: Hitachi, Ltd., Tokyo (JP); Hitachi Electronic Devices Co.,, Mobara (JP)

( * ) Notice: Subject to any disclaimer, the term of this patent is extended or adjusted under 35 U.S.C. 154(b) by 184 days.

(21) Appl. No.: 09/698,273

(22) Filed: Oct. 30, 2000

(30) Foreign Application Priority Data

Oct. 29, 1999 (JP) ..... 11-308163

(51) Int. Cl.[7] ..... H01J 29/46

(52) U.S. Cl. ..... 313/414; 313/417; 313/444; 313/457; 313/460

(58) Field of Search ..... 313/409, 410, 313/411, 412, 413, 414, 416, 417, 441, 444, 456, 457, 458, 460

(56) References Cited

U.S. PATENT DOCUMENTS

| | | | | |
|---|---|---|---|---|
| 4,827,181 A | | 5/1989 | Cho | 313/414 |
| 4,978,886 A | | 12/1990 | Miyamoto et al. | 313/414 |
| 6,239,542 B1 | * | 5/2001 | Dekker et al. | 313/412 |
| 6,239,546 B1 | * | 5/2001 | Wada et al. | 313/456 |
| 6,255,767 B1 | * | 7/2001 | Lee et al. | 313/414 |

FOREIGN PATENT DOCUMENTS

| | | |
|---|---|---|
| EP | 1096540 | 5/2001 |
| JP | 01-169852 | 7/1989 |
| JP | 08-171870 | 7/1996 |
| JP | 10-233175 | 9/1998 |

* cited by examiner

*Primary Examiner*—Nimeshkumar D. Patel
*Assistant Examiner*—Thelma Sheree Clove
(74) *Attorney, Agent, or Firm*—Antonelli, Terry, Stout & Kraus, LLP

(57) ABSTRACT

A cathode ray tube has a phosphor screen and an electron gun. The electron gun includes an electron beam generating section and an electron beam focusing section for focusing an electron beam from the electron beam generating section onto the phosphor screen. The electron beam generating section and the electron beam focusing section are mounted in predetermined spaced relationship on plural insulator support rods. The electron beam focusing section includes at least one compound electrode formed of a first electrode member, a second electrode member and a plate-like electrode member sandwiched therebetween. The plate-like electrode member is fabricated from a material thicker than materials from which the first and second electrode members are fabricated. The plate-like electrode member is laser-welded to the first and second electrode members at points of edges of the first and second electrode members. The points of edges of the first and second electrode members are positioned so as not to face mounting tabs of the plate-like electrode member embedded in the insulator support rods, and edges of the plate-like electrode member extend by an approximately equal distance outwardly beyond the points of edges of the first and second electrode members welded to the plate-like electrode member.

13 Claims, 12 Drawing Sheets

FIG. 2A1
FIG. 2B1
FIG. 2C1

FIG. 2A2
FIG. 2B2
FIG. 2C2
1
1a
1b
1c
2
2a
2b
2c
2d
3
3a
3b
3c
53
A
B
C
E
F
G
H
J
K
M
P
ΔW
IID

FIG. 3A1
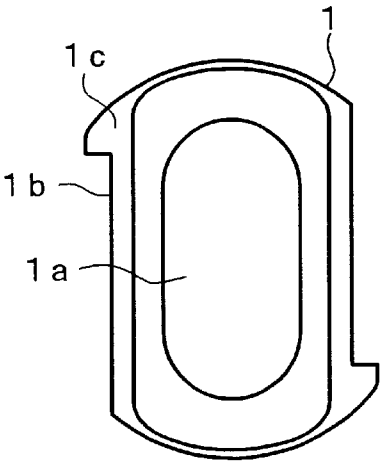
FIG. 3A2
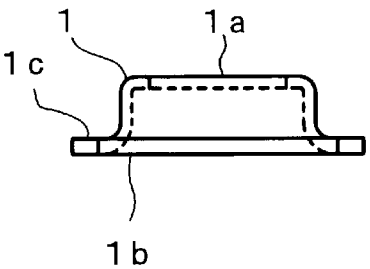
FIG. 3B1
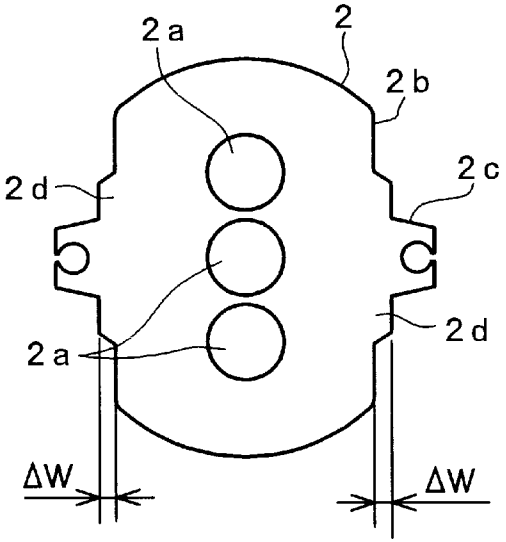
FIG. 3B2
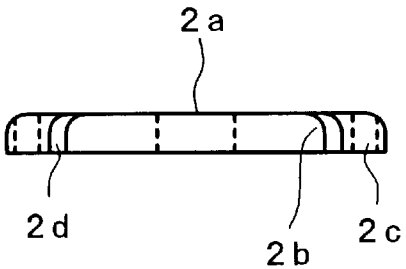
FIG. 3C1
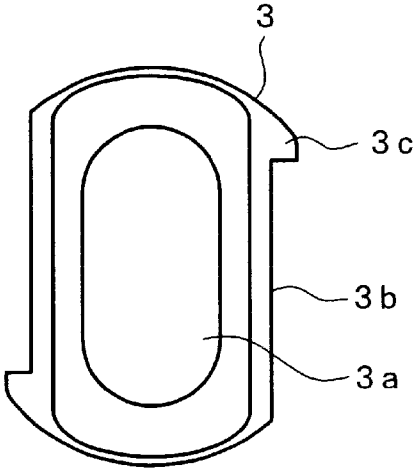
FIG. 3C2
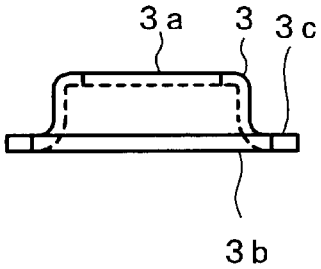

FIG. 4A1
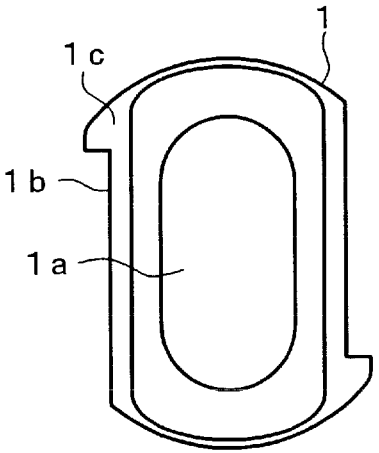
FIG. 4A2
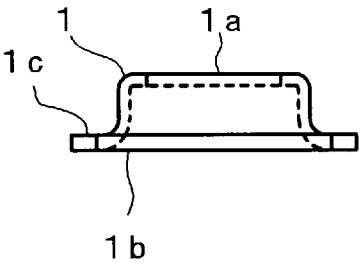
FIG. 4B1
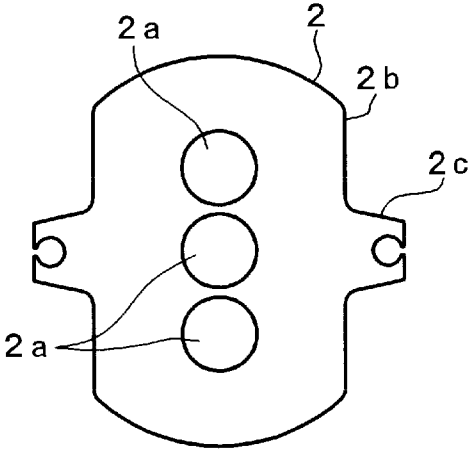
FIG. 4B2
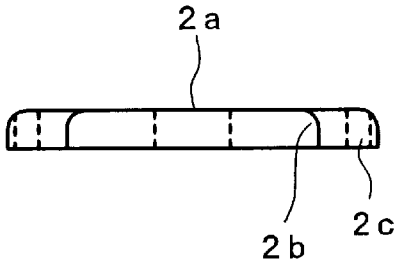
FIG. 4C1
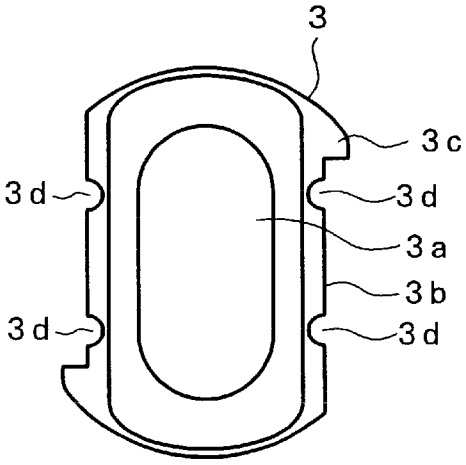
FIG. 4C2
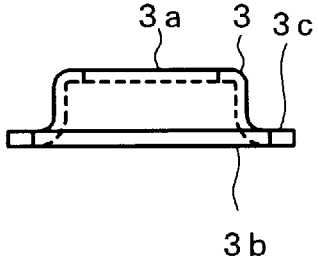

FIG. 11A1
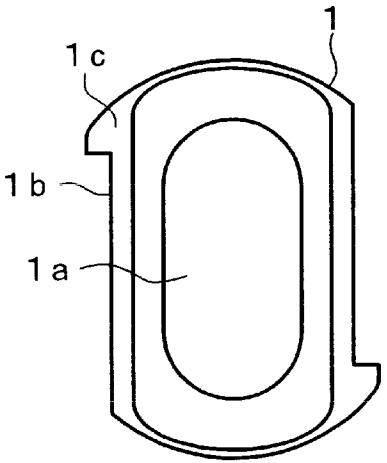
FIG. 11A2
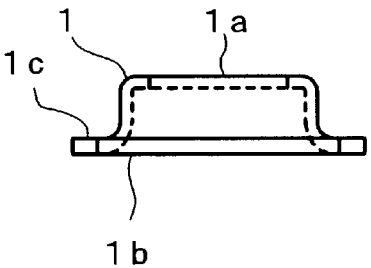
FIG. 11B1
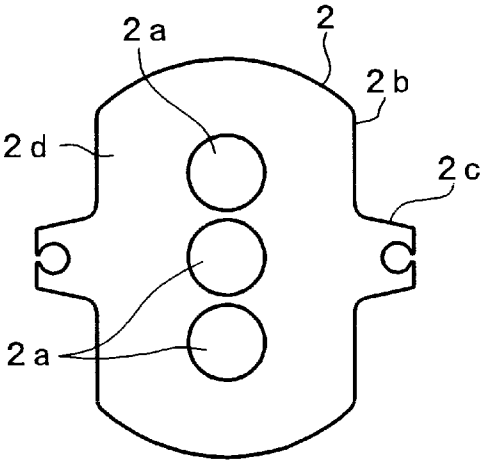
FIG. 11B2
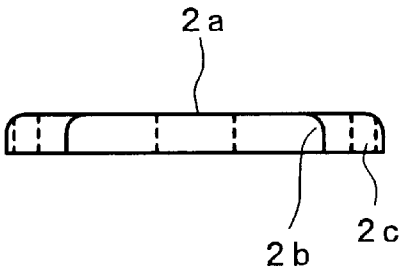
FIG. 11C1
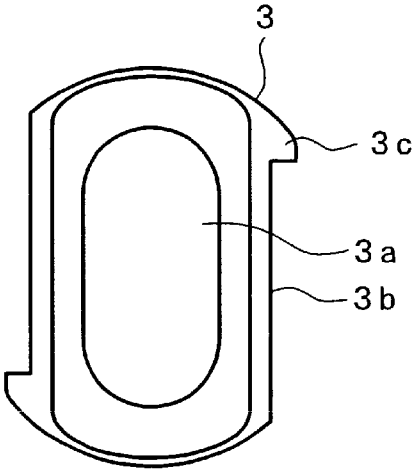
FIG. 11C2
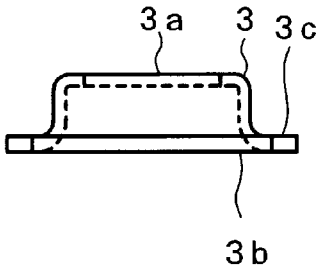

CATHODE RAY TUBE HAVING AN IMPROVED ELECTRODE ASSEMBLY

BACKGROUND OF THE INVENTION

The present invention relates to a cathode ray tube, and in particular to a cathode ray tube having reliability enhanced by improving welding accuracy of an electrode fabricated by stacking and welding together a plurality of electrode members in an electron gun housed in its vacuum envelope.

Color cathode ray tubes such as a color picture tube and a display tube, which are typical cathode ray tubes, are widely used for reception of TV broadcast and monitors of various kinds of information processing equipment because of their high-definition image reproduction capability.

Color cathode ray tubes of such a kind have a vacuum envelope comprised of a panel, a neck and a funnel for connecting the panel and the neck, a phosphor screen formed on an inner surface of the panel, and an electron gun housed in the neck for projecting an electron beam toward the phosphor screen. Especially, widely used are color cathode ray tubes employing an in-line type electron for projecting a plurality of electron beams parallel with each other in a horizontal plane.

FIG. 10 is a side view of an essential part of an embodiment of a configuration of an in-line type electron gun used for a color cathode ray tube, viewed in a direction perpendicular to a direction of the in-line arrangement of electron beams. In FIG. 10, reference numeral 31 denotes cathodes, 32 is a first electrode serving as a control electrode, 33 is a second electrode serving as an accelerating electrode, and the cathodes 31, the first electrode 32 and the second electrode 33 form an electron beam generating section.

Reference numeral 34 denotes a third electrode, and 35 is a fourth electrode. In this example, the fourth electrode 35 are formed of two tube-like electrodes 35*a* and 35*b*, and they serve as two focus electrodes. Reference numeral 36 denotes a fifth electrode, and the fifth electrode 36 and the tube-like electrode 35*b* of the fourth electrode 35 which forms a main lens therebetween. Reference numeral 37 denotes a shield cup, which is welded to the fifth electrode 36. The cathodes 31 and the first to fifth electrodes 32–36 are spaced with predetermined spacings and fixed in the predetermined order by a pair of insulator support rods (multiform glasses) 38. Reference numeral 39 denotes a stem, and the cathodes and the electrodes are supplied with display signals or operating voltages via stem pins 40 sealed through the stem 39.

Three electron beams are generated by the electron beam generating section which is a triode section comprised of the cathodes 31, the first electrode 32 and the second electrode 33, and are accelerated and focused by the third electrode 34, the fourth electrode 35 and the fifth electrode 36 such that the three electron beams are subjected to a desired focusing action by the main lens formed between opposing end faces of the fifth electrode 36 and the electrode 35*b* of the fourth electrode 35 and then directed toward the phosphor screen.

In this type of an electron gun, the first electrode 32 and the second electrode 33 are plate-like electrodes, and the third electrode 34 and the fourth electrode 35 are compound electrodes fabricated by stacking and welding together plural electrode members including a cup-shaped electrode member and a plate-like member.

FIGS. 11A1, 11A2, 11B1, 11B2, 11C1 and 11C2 are plan views and side views of electrode members forming the compound electrode shown in FIG. 10. FIGS. 11A1 and 11A2 are plan and side views of a first electrode member 1, respectively, FIGS. 11B1 and 11B2 are plan and side views of a second electrode member 2, respectively, and FIGS. 11C1 and 11C2 are plan and side views of a third electrode member 3, respectively. The first electrode member 1 and the third electrode member 3 are attached and welded by laser to the top and bottom surfaces of the second electrode member 2, respectively.

The first electrode member 1 and the third electrode member 3 are cup-shaped electrode members having rims 1*b* and 3*b*, respectively, and are formed by a drawing press. The second electrode member 2 are a plate electrode thicker than the first electrode member 1 and the third electrode member 3.

The first electrode member 1 is formed with a single opening (an electron beam-transmissive opening) 1*a* in a bottom at an end of its cup shape and the rim 1*b* at the other end of the cup shape. The rim 1*b* is formed with a protrusion 1*c* in a corner thereof for rotational alignment of the first electrode member 1 in an assembly or welding an electrical lead thereto for applying a voltage to the first electrode member 1. Similarly, the third electrode member 3 is formed with a single opening (an electron beam-transmissive opening) 3*a* in a bottom at an end of its cup shape and the rim 3*b* at the other end of the cup shape. The rim 3*b* is formed with a protrusion 3*c* in a corner thereof for indicating a position of the third electrode member 3 in an assembly or welding an electrical lead thereto for applying a voltage to the third electrode member 3.

The second electrode member 2 is formed with three electron beam-transmissive apertures 2*a* in its central portion on its major axis. The second electrode member 2 is fabricated by a simple punching which pierces the three apertures in a thick metal plate simultaneously with blanking, or trimming. An edge 2*b* is used for welding and is provided with tabs 2*c* approximately at centers at the respective long sides of the second electrode member 2 for being embedded into the insulator support rods (multiform glasses) 38 and thereby being fixed.

FIGS. 12A, 12B and 12C are illustrations for explaining a structure of a compound electrode integrally assembled and its welded condition, FIG. 8A is a plan view of the compound electrode, FIG. 12B is a cross-sectional view of the whole structure of the compound electrode of FIG. 12A taken along line VIIIB—VIIIB of FIG. 12A, and FIG. 12C is an enlarged cross-sectional view of an essential part of a welded portion in a cross section of the compound electrode of FIG. 12A taken along line VIIIC—VIIIC of FIG. 12A. In FIG. 12A, two positions corresponding to a pair of insulator support rods (multiform glasses) 38 are indicated by two-dot chain lines.

The first electrode member 1 and the third electrode member 3 are attached to the top and bottom surfaces of the second electrode member 2, respectively, such that the edge of the rim 1*b* of the first electrode member 1 and the edge of the rim 3*b* of the third electrode member 3 are aligned with the edge 2*b* of the second electrode member 2, and then they are welded together by irradiating a laser beam onto the edges of the interface between the adjacent electrode members. In FIGS. 12A and 12C, the weld points are denoted by "W→".

As shown in FIGS. 12A and 12B, the first, second and third electrodes 1, 2, 3 are attached together, and then, as shown in FIG. 12C, they are welded together by irradiating a laser beam L horizontally onto the edges of the interface between the mutually adjacent electrode members. The laser welding in this case employs a multiple-beam multiple-spot welding method capable of welding two or more spots simultaneously. In FIG. 12C, the weld points are denoted by circles "○".

The above-explained compound electrodes are not limited to one comprised of three electrode members as explained above, but are applicable to one comprised of a plate-like electrode member and a cup-shaped electrode member stacked and welded on the plate-like electrode member.

SUMMARY OF THE INVENTION

But, as shown in FIG. 12D, when the second electrode member 2 is punched out by use of a die 50 and a punch 51, sloping surfaces 53 are produced at forward edges of the second electrode member 2 in a direction of travel of the punch 51 because its material flows into the die 50, and these sloping surfaces 53 are generally called "shear droop." Consequently, as shown in FIG. 12C, a gap occurs between the edge of the first electrode member 1 and the shear droop 53 of the second electrode member 2 welded to the first electrode member 1. A similar phenomenon also occurs when a thin material is used, but the above phenomenon is pronounced when a thick material is used.

Welding of the stacked. electrode members is performed by irradiating a laser beam L horizontally onto the interface of the stacked edges of the electrode members, as shown in FIG. 12C.

The laser welding in this case employs a multiple-beam multiple-spot welding method capable of welding two or more spots simultaneously. In FIG. 12C, two laser beams L perform welding of the first and second electrode members 1, 2 and welding of the second and third electrode members 2, 3, respectively, at the same time. Reference numeral 100 denote lenses.

Both of the two laser beams L having the same focal length are focused onto the edges of the stacked electrode members, and this means that, in the case of welding an edge of the second electrode member 2 having the shear droop, the laser beam L is focused onto the interface between the edge of the first electrode member 1 and a point of the edge of the second electrode member 2 where the shear droop begins, as shown in FIG. 12C. Therefore, a weld point of the first and second electrode members 1, 2 is displaced from a focal point of the laser beam by a distance D ($D \neq 0$). Consequently, the energy of the laser beam becomes weak in the innermost of the shear droop, resulting in so-called weak welding. The welding strength in the innermost of the shear droop is poor such that a compound electrode is not sufficiently integrally assembled, thereby sufficient assembling accuracy is not achieved, and further it is difficult to attain long lifetime of a cathode ray tube because of variations of performance characteristics due to aging.

To prevent occurrence of such weak welding, the power of the laser beam L has been sometimes increased. In this case, there is a problem in that, in FIG. 12C, the energy of the laser beam irradiated to the weld point of the second and third electrode members 2, 3 becomes excessive, and consequently, it causes loss in material of the third electrode member 3 made of a thin material due to melting and unwanted distortion and they cause deformation in the third electrode member 3 during subsequent heat treatment and deteriorate reliability.

It is an object of the present invention to provide a cathode ray tube incorporating an electron gun employing a high-precision and highly reliable electrode capable of preventing occurrence of the weak welding by solving the above-explained problem with the prior art.

To accomplish the above objects, in accordance with an embodiment of the present invention, there is provided a cathode ray tube comprising an evacuated envelope including a panel portion, a neck portion and a funnel portion for connecting the panel portion and the neck portion, a phosphor screen formed on an inner surface of the panel portion, and an electron gun housed in the neck portion; the electron gun comprising an electron beam generating section having a cathode, an electron beam control electrode and an accelerating electrode arranged in the order named for projecting an electron beam toward the phosphor screen, and an electron beam focusing section for focusing the electron beam from the electron beam generating section onto the phosphor screen, the electron beam generating section and the electron beam focusing section being mounted in predetermined spaced relationship on a plurality of insulator support rods, the electron beam focusing section including at least one compound electrode comprising a first electrode member, a second electrode member and a plate-like electrode member sandwiched therebetween, the plate-like electrode member being fabricated from a material thicker than materials from which the first electrode member and the second electrode member are fabricated, the plate-like electrode member being laser-welded to the first and second electrode members at points of edges of the first and second electrode members, the points of edges of the first and second electrode members being positioned so as not to face mounting tabs of the plate-like electrode member embedded in the plurality of insulator support rods, and edges of the plate-like electrode member extending by an approximately equal distance outwardly beyond the points of edges of the first and second electrode members welded to the plate-like electrode member.

To accomplish the above objects, in accordance with another embodiment of the present invention, there is provided a cathode ray tube comprising an evacuated envelope including a panel portion, a neck portion and a funnel portion for connecting the panel portion and the neck portion, a phosphor screen formed on an inner surface of the panel portion, and an electron gun housed in the neck portion; the electron gun comprising an electron beam generating section having a cathode, an electron beam control electrode and an accelerating electrode arranged in the order named for projecting an electron beam toward the phosphor screen, and an electron beam focusing section for focusing the electron beam from the electron beam generating section onto the phosphor screen, the electron beam generating section and the electron beam focusing section being mounted in predetermined spaced relationship on a plurality of insulator support rods, the electron beam focusing section including at least one compound electrode comprising a first cup-shaped electrode member having a flange at an open end thereof, a second cup-shaped electrode member having a flange at an open end thereof and a plate-like electrode member sandwiched therebetween, the plate-like electrode member being fabricated from a material thicker than materials from which the first cup-shaped electrode member and the second cup-shaped electrode member are fabricated, the plate-like electrode member being laser-welded to the first and second cup-shaped electrode members at points of edges of the flanges of the first and second cup-shaped electrode members, the points of edges of the flanges of the first and second cup-shaped electrode members being positioned so as not to face mounting tabs of the plate-like electrode member embedded in the plurality of insulator support rods, and edges of the plate-like electrode member extending by an approximately equal distance outwardly beyond the points of edges of the flanges of the first and second cup-shaped electrode members welded to the plate-like electrode member.

To accomplish the above objects, in accordance with another embodiment of the present invention, there is provided a cathode ray tube comprising an evacuated envelope including a panel portion, a neck portion and a funnel portion for connecting the panel portion and the neck portion, a phosphor screen formed on an inner surface of the panel portion, and an electron gun housed in the neck portion; the electron gun comprising an electron beam generating section having a cathode, an electron beam control electrode and an accelerating electrode arranged in the order named for projecting an electron beam toward the phosphor screen, and an electron beam focusing section for focusing the electron beam from the electron beam generating section onto the phosphor screen, the electron beam generating section and the electron beam focusing section being mounted in predetermined spaced relationship on a plurality of insulator support rods, the electron beam focusing section including a focus electrode, a compound electrode and an anode supplied with a highest voltage, arranged in the order named toward the phosphor screen, the compound electrode supplied with an intermediate voltage between the highest voltage and a voltage supplied to the focus electrode, the intermediate voltage being obtained by dividing the highest voltage via a resistor housed in the cathode ray tube, the compound electrode comprising a first cup-shaped electrode member having a flange at an open end thereof, a second cup-shaped electrode member having a flange at an open end thereof and a plate-like electrode member sandwiched therebetween, the plate-like electrode member being fabricated from a material thicker than materials from which the first cup-shaped electrode member and the second cup-shaped electrode member are fabricated, the plate-like electrode member being laser-welded to the first and second cup-shaped electrode members at points of edges of the flanges of the first and second cup-shaped electrode members, the points of edges of the flanges of the first and second cup-shaped electrode member being positioned so as not to face mounting tabs of the plate-like electrode member embedded in the plurality of insulator support rods, and edges of the plate-like electrode member extending by an approximately equal distance outwardly beyond the points of edges of the flanges of the first and second cup-shaped electrode members welded to the plate-like electrode member.

To accomplish the above objects, in accordance with another embodiment of the present invention, there is provided a cathode ray tube comprising an evacuated envelope including a panel portion, a neck portion and a funnel portion for connecting the panel portion and the neck portion, a phosphor screen formed on an inner surface of the panel portion, and an electron gun housed in the neck portion; the electron gun comprising an electron beam generating section having a cathode, an electron beam control electrode and an accelerating electrode arranged in the order named for projecting an electron beam toward the phosphor screen, and an electron beam focusing section for focusing the electron beam from the electron beam generating section onto the phosphor screen, the electron beam generating section and the electron beam focusing section being mounted in predetermined spaced relationship on a plurality of insulator support rods, the electron beam focusing section including at least one compound electrode comprising a first electrode member, a second electrode member and a plate-like electrode member sandwiched therebetween, the plate-like electrode member being fabricated from a material thicker than materials from which the first electrode member and the second electrode member are fabricated, the first electrode member being stacked on a surface of the plate-like electrode member having shear droop caused in punching out the plate-like electrode member, the second electrode member being formed with cutouts at edges thereof, the plate-like electrode member being laser-welded to the second electrode member and the first electrode member at the cutouts of the second electrode member and points of edges of the first electrode member corresponding to the cutouts of the second electrode member, respectively, the cutouts of the second electrode member and the points of edges of the first electrode member being positioned so as not to face mounting tabs of the plate-like electrode member embedded in the plurality of insulator support rods.

In the punching operation, the thicker the material, the greater the shear droop. Generally in a compound electrode, a rim of a cup-shaped electrode member made of a thin material is welded to a thick plate-like electrode member. The edge of the thick plate-like electrode member is extended beyond the rim of the cup-shaped electrode member such that, even if the shear droop of the thick plate-like electrode member is somewhat superposed on the rim of the cup-shaped electrode member, a gap formed therebetween is made smaller, or if the shear droop of the thick plate-like electrode member is extended so as not to be superposed on the rim of the cup-shaped electrode member, no gap is formed between thick plate-like electrode member and the cup-shaped electrode member at a weld point of the two electrode members, and consequently, the respective laser beams are focused on intended points and realizes precision welding.

The present invention is not limited to the above configurations, but various changes and modifications may be made without departing from the nature and spirit of the present invention.

BRIEF DESCRIPTION OF THE DRAWINGS

In the accompanying drawings, in which like reference numerals designate similar components throughout the figures, and in which:

FIGS. 2A1, 2A2, 2B1, 2B2, 2C1 and 2C2 are plan and side views of the first, second and third electrode members, respectively, constituting the compound electrode of FIGS. 1A–1C;

FIGS. 3A1, 3A2, 3B1, 3B2, 3C1 and 3C2 are plan and side views of first, second and third electrode members, respectively, constituting a compound electrode of a second embodiment of the present invention;

FIGS. 4A1, 4A2, 4B1, 4B2, 4C1 and 4C2 are plan and side views of first, second and third electrode members, respectively, constituting a compound electrode of a third embodiment of the present invention;

FIGS. 11A1, 11A2, 11B1, 11B2, 11C1 and 11C2 are plan and side views of first, second and third electrode members, respectively, constituting a compound electrode used for the in-line type electron gun of FIG. 10;

DETAILED DESCRIPTION OF THE PREFERRED EMBODIMENTS

The embodiments of the present invention will be explained in detail by reference to the drawings.

Figure 1A:
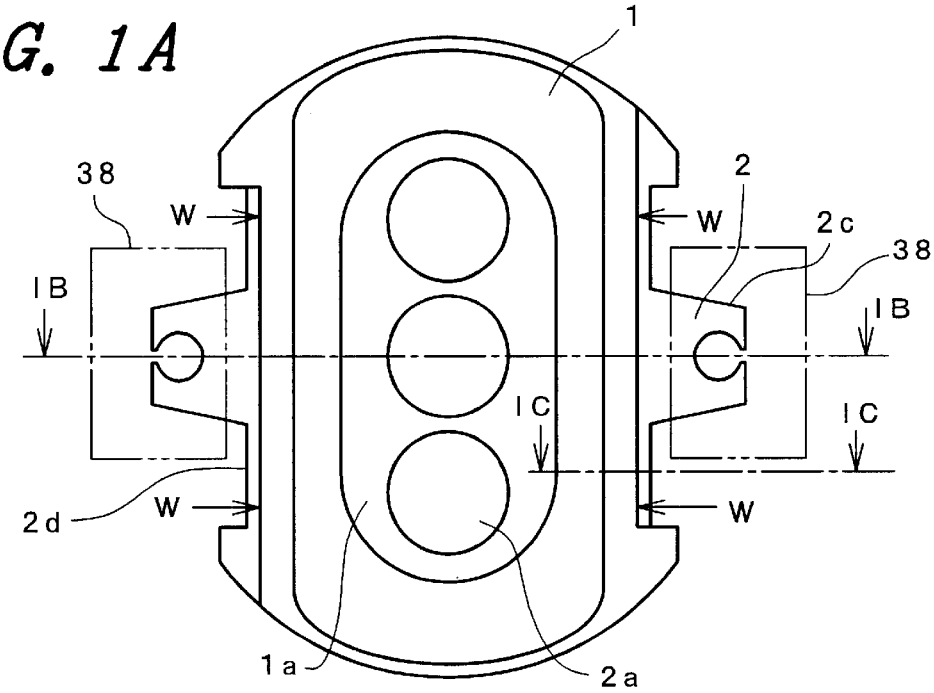
FIGS. 1A–1C are illustrations of a compound electrode of a first embodiment of the present invention, FIG. 1A being a plan view of the compound electrode, FIG. 1B being a cross-sectional view of the compound electrode of FIG. 1A taken along line IB—IB of FIG. 1A, and FIG. 1C being an enlarged fragmentary cross-sectional view of the compound electrode of FIG. 1A taken along line IC—IC of FIG. 1A for explaining its welding condition.
Figure 1B:
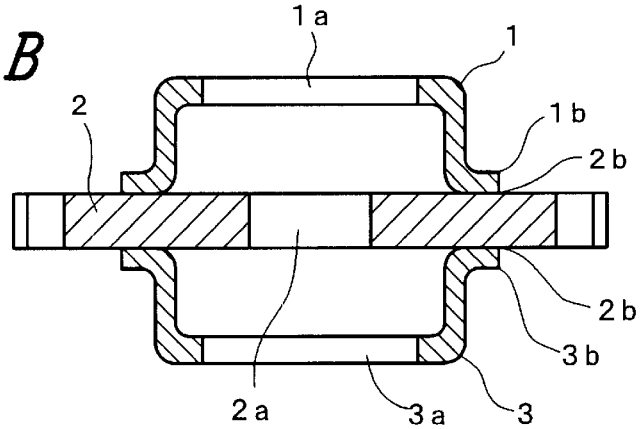
Figure 1C:
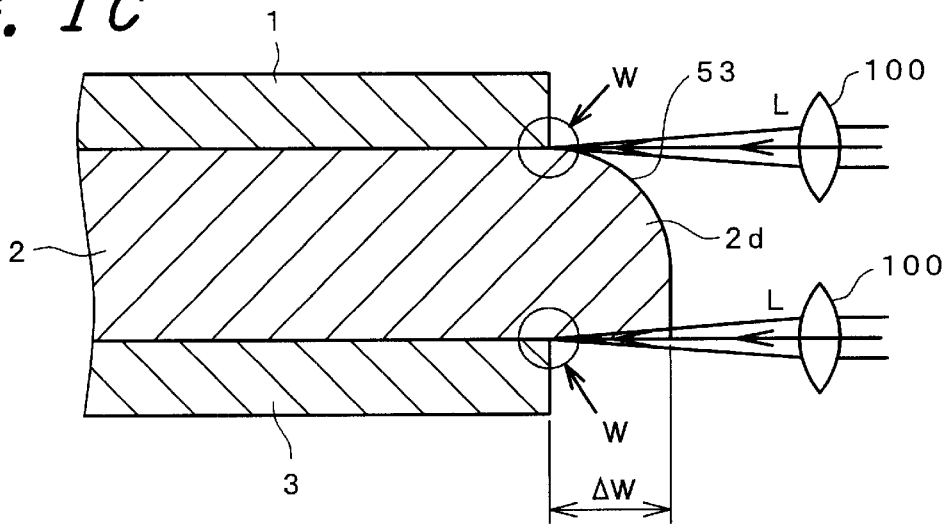

FIGS. 1A–1C are illustrations of a configuration and welding conditions of a compound electrode for explaining a first embodiment of the present invention. FIG. 1A is a plan view of the compound electrode, FIG. 1B is an cross-sectional view of the compound electrode of FIG. 1A taken along line IB—IB of FIG. 1A, and FIG. 1C is an enlarged fragmentary cross-sectional view of stacked and welded portions of electrode members making up the compound electrode of FIG. 1A taken along line IC—IC of FIG. 1A. The same reference numerals as utilized in FIGS. 12A–12D designate functionally similar parts or portions in FIGS. 1A–1C. In FIG. 1A, two positions corresponding to a pair of insulator support rods (multiform glasses) 38 are indicated by two-dot chain lines.

In this embodiment, entire edges 2*d* of the second electrode member 2 are extended outwardly beyond respective edges of the first electrode member 1 and the third electrode member 3 such that sloped portions produced by the shear droop do not form gaps at weld points of the stacked electrode members 1, 2, 3.

As shown in FIG. 1C, the drooping portion 53 of the second electrode member 2 is extended outwardly and sufficiently to form a protruding portion 2*d* and prevent formation of a gap between an edge of the first electrode member 1 and the second electrode member 2. With this configuration, two weld points indicated by circles on the first electrode member 1 and the third electrode member 3, respectively, lie on the vertical line and a difference D in horizontal distance between the two weld points becomes zero. Consequently, in the case of using a multiple-beam multiple-spot welding method capable of welding two or more spots simultaneously, each of two laser beams L having the same focal length is focused on a corresponding one of the two intended weld points, and thereby both welding of the first and second electrode members 1, 2 and welding of the second and third electrode members 2, 3 are performed with the two laser beams of a required energy, respectively, to provide a required welding strength and no defective welding occurs.

Further, the need for readjusting the focus and strength of the two laser beams for the respective weld points is eliminated and thereby a precision compound electrode is obtained.

FIGS. 2A1, 2A2, 2B1, 2B2, 2C1 and 2C2 are plan and side views of the first, second and third electrode members, respectively, constituting the compound electrode of FIGS. 1A–1C, the first to third electrode members 1 to 3 are basically similar in shape to the conventional first to third electrode members 1 to 3, respectively, explained in connection with FIGS. 11A1, 11A2, 11B1, 11B2, 11C1 and 11C2, and the same reference numerals as utilized in FIGS. 11A1, 11A2, 11B1, 11B2, 11C1 and 11C2 designate functionally similar parts or portions in FIGS. 2A1, 2A2, 2B1, 2B2, 2C1 and 2C2.

The first and third electrode members 1, 3 are fabricated from a material of 0.245 mm in thickness, and the second electrode member 2 is fabricated from a material of 0.7 mm in thickness. In one example, the first, second and third electrode members 1, 2, 3 have the following dimensions in connection with FIGS. 2A1 to 2C2:

A=8.2 mm, B=8.85 mm, C=17.2 mm, E=1.4 mm,

F=0.7 mm, G=1.4 mm, H=11.9 mm, and J=8.95 mm.

In this embodiment, rim portions 1*b*, 3*b* of the first and third electrode members 1, 3, respectively, welded to the respective surfaces of the second electrode member 2 by the laser beam, and portions of the edges 2*b* which are to be welded of the second electrode member 2 are extended outwardly by a distance ΔW from conventional positions indicated by two-dot chain lines in FIG. 2B1. With this configuration, no gaps are formed in welded portions of the first to third electrode members 1–3 stacked and welded as explained in connection with FIGS. 1A–1C, and consequently, the first and second electrode members 1, 2 are welded together with high precision under conditions similar to those for welding of the second and third electrode members 2, 3.

Figures 2D, 2E:
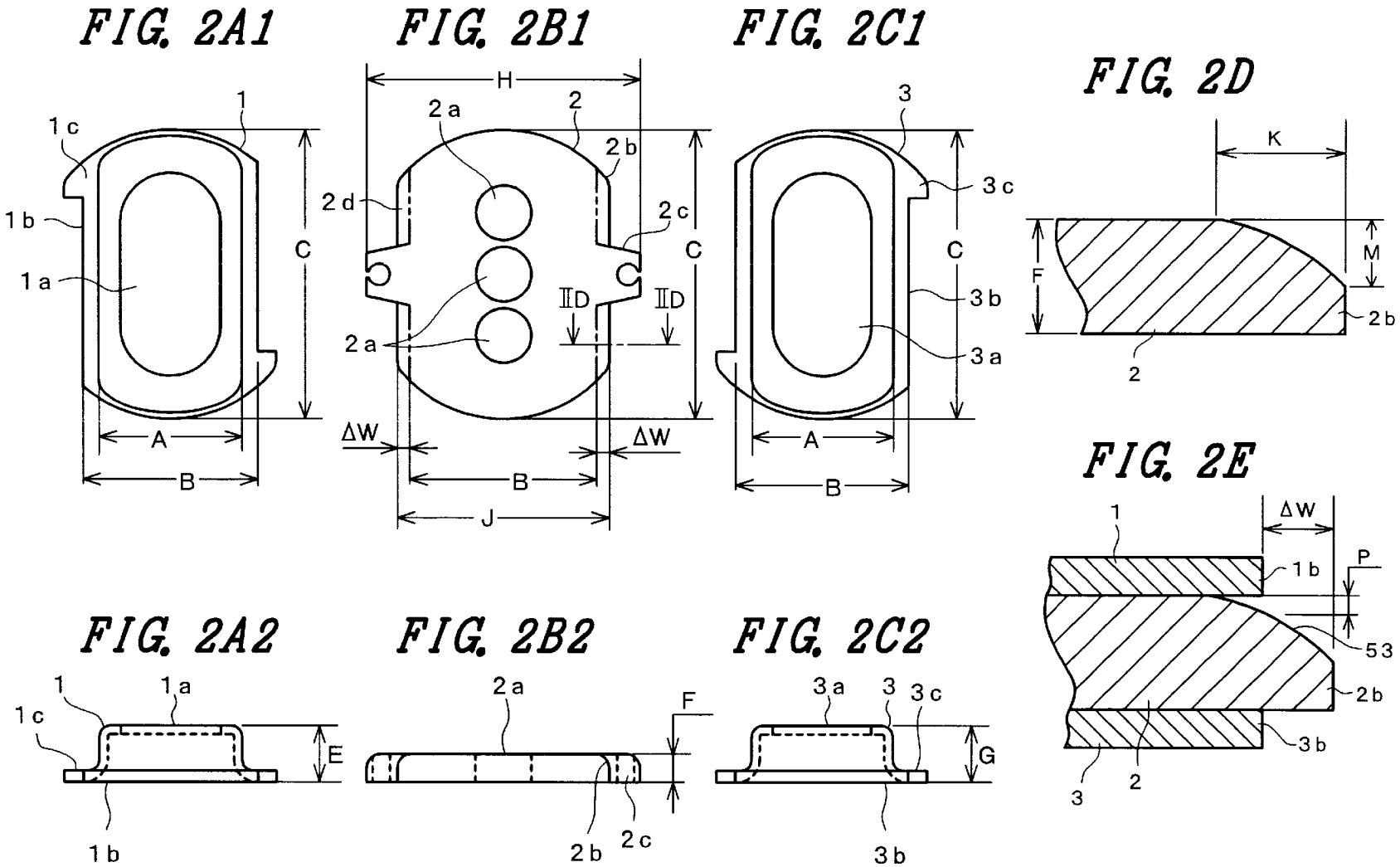
FIG. 2D is a cross-sectional view of the second electrode member of FIG. 2B1 taken along line IID—IID of FIG. 2B1.
FIG. 2E is an enlarged fragmentary cross-sectional view of the compound electrode for explaining a relationship between an extension $\Delta W$ of the second electrode member and a gap P formed between an edge of the first electrode member and a drooping portion of the second electrode member.

FIG. 2D is a cross-sectional view of the second electrode member 2 of FIG. 2B1 taken along line IID—IID of FIG.

2B1 for explaining the amount of one example of the shear droop produced at the sheared edge 2*b* of the second electrode member 2. In the case of the second electrode member 2 fabricated from a material of 0.7 mm in thickness, the width K of the shear droop was in a range of from about 0.4 mm to about 1.0 mm, and the amount M of the shear droop was in a range of from about 0.08 mm to about 0.15 mm.

As is apparent from FIG. 1C1, if the edge 2*b* of the second electrode member 2 is made to extend excessively beyond the rim portions 1*b*, 3*b* of the first and third electrode members 1, 3, the protruding portion 2*d* of the second electrode member 2 blocks such a significant portion of the laser beam for welding the second and third electrode members 2, 3 that sufficient welding is not always achieved, and therefore it is preferable to limit the extension ΔW to 0.3 mm.

Even if the extension ΔW is made equal to or less than 0.3 mm, and as a result, as shown in FIG. 2E, the gap P is formed between the edge 1*b* of the first electrode member 1 and the drooping portions 53 of the second electrode member 2, it was found out by experiments that the gap P not greater than 0.08 mm is practically acceptable.

In assembling of the compound electrode, an unacceptable amount of the shear droop often occurs when plate-like electrode members are fabricated from a material having a thickness equal to or more than 0.5 mm.

As explained above, if an edge of one of the two electrode members to be welded is displaced an excessively great distance inwardly from an edge of the other of the two electrode members, a significant amount of the laser beam is blocked by the outwardly extending edge of the other of the two electrode members, and as a result, sufficient welding strength of the electrode members is not obtained. Therefore, the weld points as indicated by "w→" in FIG. 1A are disposed at positions other than positions corresponding to tabs 2*c* approximately at centers at the respective long sides of the second electrode member 2 to be embedded into the insulator support rods (multiform glasses) 38.

In the present embodiment, the laser beam is focused on predetermined positions to be welded, thereby precision welding is realized, degradation of strength of the welded portions is prevented, the compound electrode is sufficiently integrally assembled, and deterioration of precision due to temperature rise in heat treatment in the manufacturing process and in operation of a cathode ray tube is prevented, and consequently, the present embodiment provides a cathode ray tube capable of a high-quality image display.

FIGS. 3A1, 3A2, 3B1, 3B2, 3C1 and 3C2 are plan and side views of first, second and third electrode members, respectively, constituting a compound electrode of a second embodiment of the present invention, and the first to third electrode members 1 to 3 are basically similar in shape to the first to third electrode members 1 to 3, respectively, of the first embodiment explained in connection with FIGS. 2A1, 2A2, 2B1, 2B2, 2C1 and 2C2, and the same reference numerals as utilized in FIGS. 2A1, 2A2, 2B1, 2B2, 2C1 and 2C2 designate functionally similar parts or portions in FIGS. 2A1, 2A2, 2B1, 2B2, 2C1 and 2C2.

In this embodiment also, rim portions 1*b*, 3*b* of the first and third electrode members 1, 3, respectively, welded to the respective surfaces of the second electrode member 2 by the laser beam, but only portions of the edges 2*b* which are to be welded of the second electrode member 2 are locally extended outwardly by a distance ΔW from conventional positions as shown in FIG. 3B1 to form a protruding portion 2*d*. With this configuration, smaller or no gaps due to the shear droop are formed in welded portions of the first to third electrode members 1–3 stacked and welded as explained in connection with FIGS. 1A–1C and 2A1–2E, and consequently, the first and second electrode members 1, 2 are welded together with high precision under conditions similar to those for welding of the second and third electrode members 2, 3.

In the present embodiment, the laser beam is focused on predetermined positions to be welded, thereby precision welding is realized, degradation of strength of the welded portions is prevented, the compound electrode is sufficiently integrally assembled, and deterioration of precision in operation of a cathode ray tube is prevented, and consequently, the present embodiment provides a cathode ray tube capable of a high-quality image display.

FIGS. 4A1, 4A2, 4B1, 4B2, 4C1 and 4C2 are plan and side views of first, second and third electrode members, respectively, constituting a compound electrode of a third embodiment of the present invention, and the first to third electrode members 1 to 3 are basically similar in shape to the conventional first to third electrode members 1 to 3, respectively, explained in connection with FIGS. 11A1, 11A2, 11B1, 11B2, 11C1 and 11C2, and the same reference numerals as utilized in FIGS. 11A1, 11A2, 11B1, 11B2, 11C1 and 11C2 designate functionally similar parts or portions in FIGS. 4A1, 4A2, 4B1, 4B2, 4C1 and 4C2.

In this embodiment also, rim portions 1*b*, 3*b* of the first and third electrode members 1, 3, respectively, are welded to the respective surfaces of the second electrode member 2 by the laser beam, but the edges 3*b* of the first electrode member 3 are formed with cutouts 3*d* at its positions corresponding to weld points.

With this configuration, the weld points of the third and second electrode members 3, 2 are displaced inwardly from the drooping portions 53 of the second electrode member 2, the weld point of the first and second electrode members 1, 2 and the weld point of the third and second electrode members 3, 2 lie on the same vertical line, and consequently, the first and second electrode members 1, 2 are welded together with high precision under conditions similar to those for welding of the second and third electrode members 2, 3.

In the present embodiment, the laser beam is focused on predetermined positions to be welded, thereby precision welding is realized, degradation of strength of the welded portions is prevented, the compound electrode is sufficiently integrally assembled, and deterioration of precision in operation of a cathode ray tube is prevented, and consequently, the present embodiment provides a cathode ray tube capable of a high-quality image display.

The present invention is not limited to compound electrodes comprised of two cup-shaped electrode members and one plate-like electrode member as explained in the above embodiments, but it is needless to say that the present invention is also applicable to compound electrodes comprised of two cup-shaped electrode members and two or more generally flat electrode members.

Figure 5:
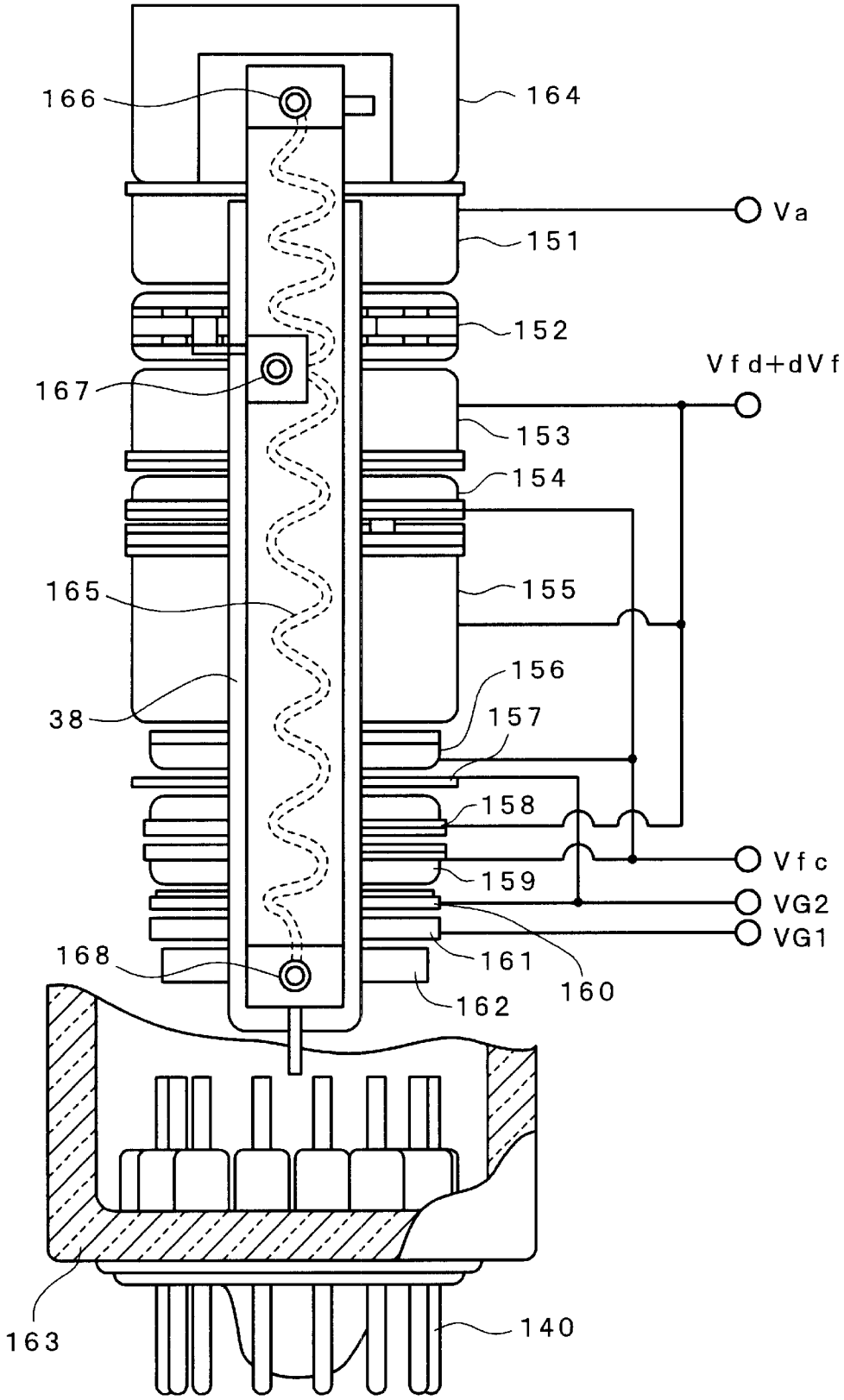
FIG. 5 is a side elevation view of an essential part of an in-line type electron gun for explaining a color cathode ray tube to which a fourth example of the present invention is applied.

FIG. 5 is a side elevation view of an essential part of an in-line type electron gun viewed in a direction perpendicular to the in-line direction of three electron beams for explaining a color cathode ray tube to which a fourth example of the present invention is applied.

In FIG. 5, reference numeral 151 denotes the anode, 152 is an intermediate electrode, 153 is a fourth member of a fifth grid electrode, 154 is a third member of the fifth grid electrode and 155 is a second member of the fifth grid electrode. A compound electrode in accordance with the present invention is used as the intermediate electrode 152.

Figure 6A:
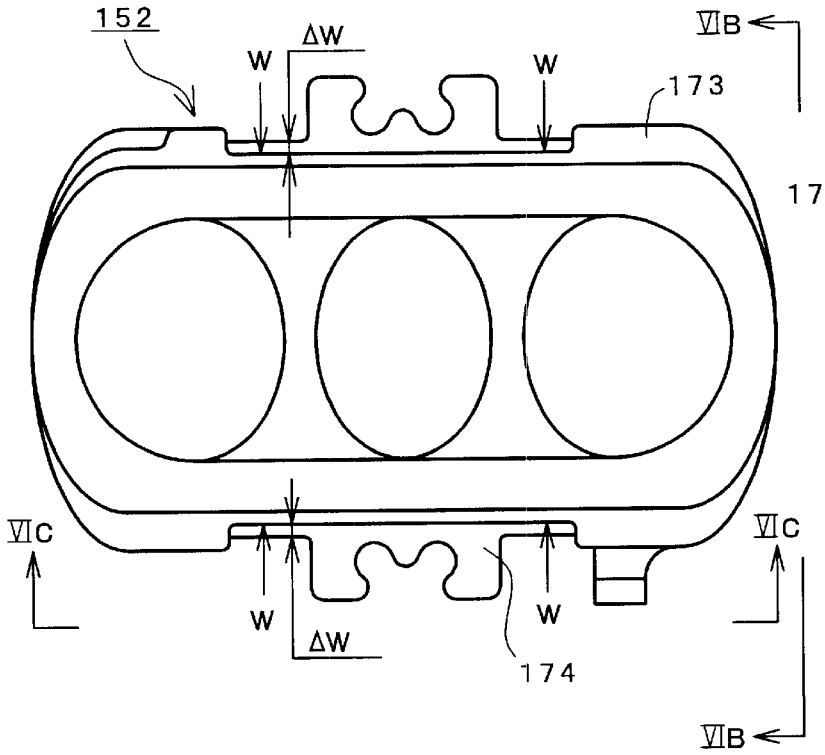
FIG. 6A is a front view of a side of an intermediate electrode facing an anode in the fourth example of the present invention.
Figure 6B:
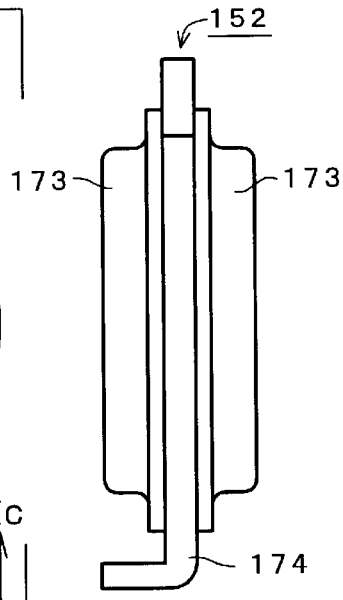
FIG. 6B is a side elevation view of the intermediate electrode of FIG. 6A, taken in the direction of the arrows VIB—VIB thereof.
Figure 6C:
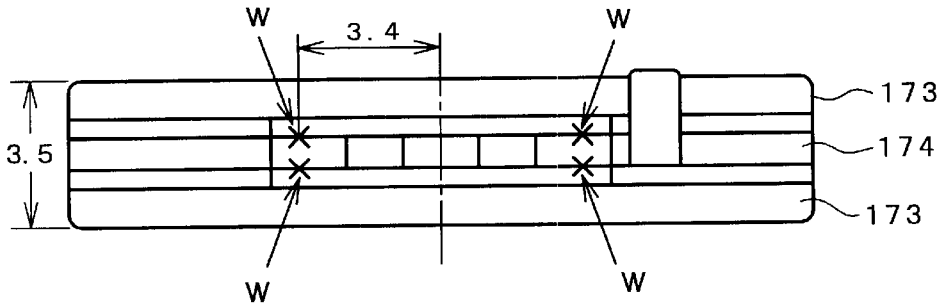
FIG. 6C is a side elevation view of the intermediate electrode of FIG. 6A, taken in the direction of the arrows VIC—VIC thereof.

FIG. 6A is a front view of the side of the intermediate electrode 152 facing the anode 151, FIG. 6B is a side elevation view of the intermediate electrode 152 of FIG. 6A, taken in the direction of the arrows VIB—VIB thereof, and FIG. 6C is a side elevation view of the intermediate electrode 152 of FIG. 6A, taken in the direction of the arrows VIC—VIC thereof. The intermediate electrode 152 comprises a pair of cup-shaped electrode members 173 and a plate-like electrode member 174 sandwiched between the pair of cup-shaped electrode members 173. The axial length of the intermediate electrode 152 is 3.5 mm.

Figure 7A:
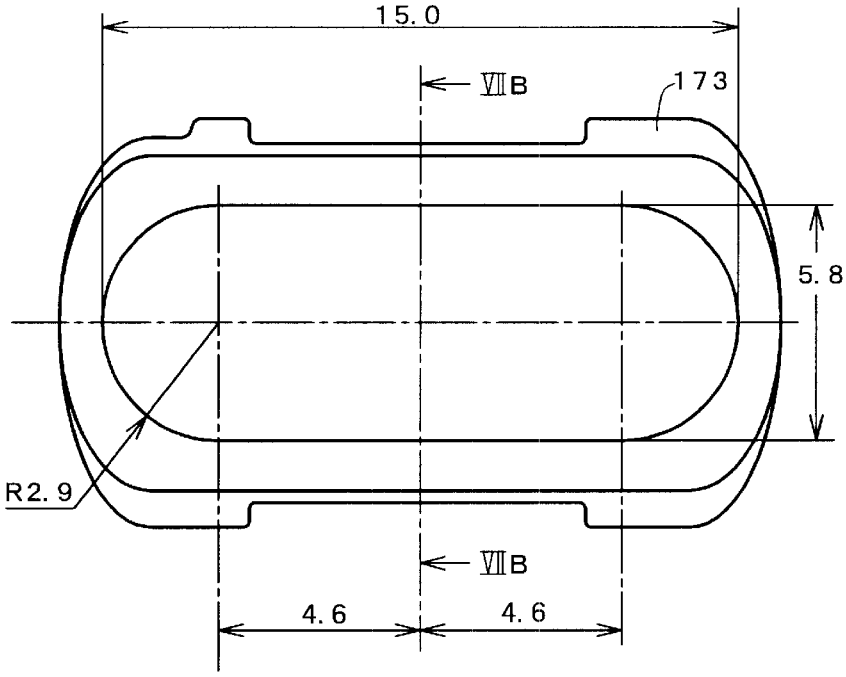
FIG. 7A is a plan view of a cup-shaped electrode member in the fourth example of the present invention and FIG. 7B is a cross-sectional view of the cup-shaped electrode member of FIG. 7A taken along line VIIB—VIIB of FIG. 7A.
Figure 7B:
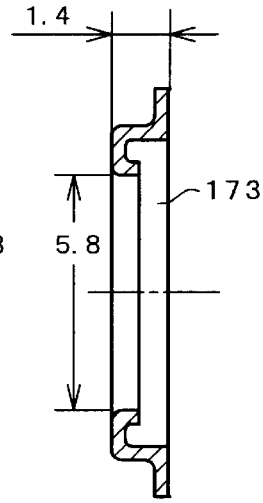

FIG. 7A is a plan view of the cup-shaped electrode member 173 and FIG. 7B is a cross-sectional view of the cup-shaped electrode member 173 taken along line VIIB—VIIB of FIG. 7A. The cup-shaped electrode member 173 is formed with a single opening elongated in the in-line direction of the electron beams which is 15 mm in major diameter and 5.8 mm in minor diameter with semicircles of 2.9 mm in radius at the left and right sides. The axial length of the cup-shaped electrode member 173 is 1.4 mm. The cup-shaped electrode member 173 is fabricated from a material of 0.245 mm in thickness.

Figure 8A:
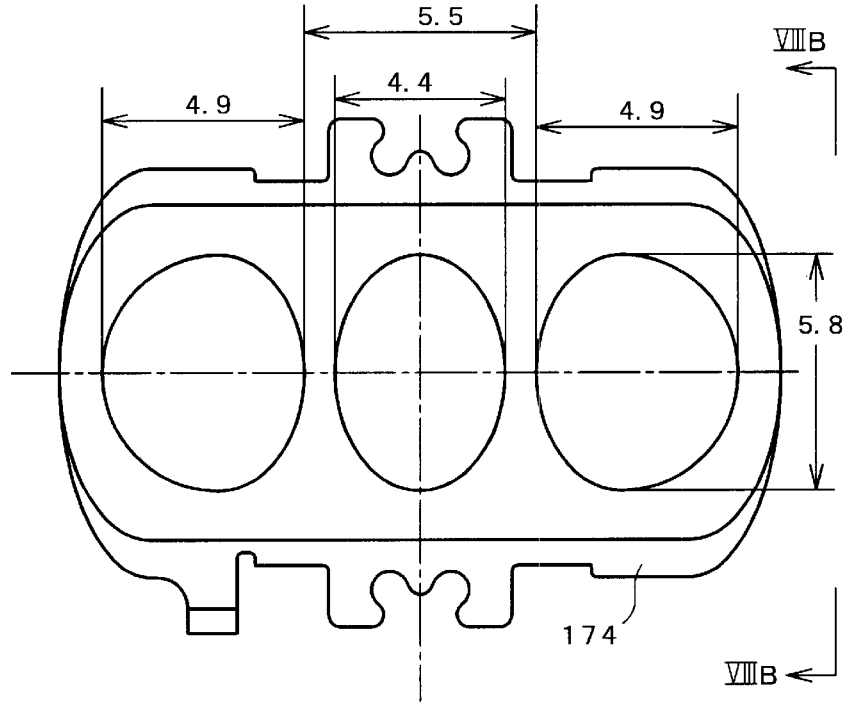
FIG. 8A is a plan view of a plate-like electrode member in the fourth example of the present invention and FIG. 8B is a side elevation view of the plate-like electrode member of FIG. 8A, taken in the direction of the arrows VIIIB—VIIIB thereof.
Figure 8B:
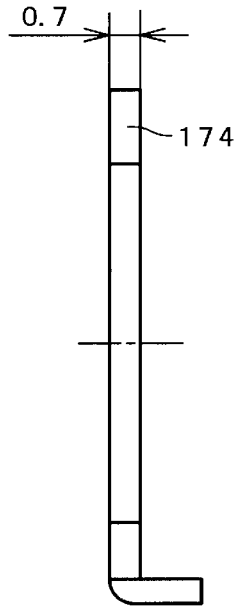

FIG. 8A is a plan view of the plate-like electrode member 174 and FIG. 8B is a side elevation view of the plate-like electrode member 74 of FIG. 8A, taken in the direction of the arrows VIIIB–VIIIB thereof. In FIG. 8A, the center electron beam aperture is elliptic, an inner side portion of the side electron beam apertures is semi-elliptic and an outer side portion of the side electron beam apertures is semicircular. The plate-like electrode member 174 is fabricated from a material of 0.7 mm in thickness.

Referring again to FIGS. 6A–6C, in this example, ΔW by which edges of the plate-like electrode member 174 extend beyond edges of the cup-shaped electrode member 173 in the vicinities of weld points is selected to be 0.05 mm, and the two cup-shaped electrode members 173 and the plate-like electrode member 174 are welded simultaneously at two points axially aligned and spaced by 3.4 mm from the center of the major axis of the plan view of the intermediate electrode 152 as shown in FIG. 6C by using a multiple-beam multiple-spot welding method.

Opposing end of the third member of the fifth grid electrode 154 and the second member of the fifth grid electrode 155 form a second-stage electrostatic quadrupole lens therebetween.

Reference numeral 156 denotes a first member of a fifth grid electrode, 157 is a fourth grid electrode, 158 is a second member of a third grid electrode, 159 is a first member of the third grid electrode, 160 is a second grid electrode, 161 is a first grid electrode, 162 are cathodes, 163 is a stem and 140 are stem pins sealed through the stem 163.

A pair of insulator support rods 138 have fixed in the predetermined order with predetermined spacings the anode 151, the intermediate electrode 152, the fourth member of the fifth grid electrode 153, the third member of the fifth grid electrode 154, the second member of the fifth grid electrode 155, the first member of the fifth grid electrode 156, the fourth grid electrode 157, the second member of the third grid electrode 158, the first member of the third grid electrode 159, the second grid electrode 160, the first grid electrode 161 and the cathodes 162, and these electrodes are mounted on the stem 163. The cathodes 162 and several of the electrodes are supplied with display signals or operating voltages via stem pins 140 sealed through the stem 163.

Reference numeral 164 denotes the shield cup, 165 is the internal resistor, 166 is its anode voltage terminal, 167 is its intermediate terminal and 168 is its low voltage terminal.

In FIG. 6, the anode 151 is supplied with an anode voltage which is the highest voltage, about 27 kV, for example, and the intermediate electrode 152 is supplied with an intermediate voltage which is 50 to 60% of the anode voltage via the internal resistor 165.

The fourth member 153 and the second member 155 of the fifth grid electrode and the second member 158 of the third grid electrode are connected with each other within the cathode ray tube and are supplied with a second focus voltage comprised of a fixed voltage of about 25% of the anode voltage superposed with a dynamic voltage dVf of about 500 to 800 V increasing with increasing deflection of the electron beams.

The third member 154 and the first member 156 of the fifth grid electrode and the first member 159 of the third grid electrode are internally connected with each other and are supplied with a first focus voltage Vfc of about 28% of the anode voltage Va.

The fourth grid electrode 157 and the second grid electrode 160 are internally connected with each other and are supplied with a screen voltage VG2 of about 500 V to about 800 V, and the first grid electrode. 161 is supplied with a voltage VG1 in a range of −50 to 0 volts.

With this structure, the anode 51, the intermediate electrode 52 and the fourth member 53 of the fifth grid electrode 53 form a main lens thereamong.

The second-stage electrostatic quadrupole lens is formed between facing portions of the third member 54 and the second member 55 of the fifth grid electrode such that the vertically strong focusing action is exerted on the electron beams when the electron beams are not deflected and the strength of the vertically strong focusing action decreases with increasing deflection of the electron beams.

One correction lens for the curvature of the image field is formed between the facing portions of the fourth member 153 and the third member 154 of the fifth grid electrode and another correction lens for the curvature of the image field is formed between the facing portions of the second member 155 and the first member 156 of the fifth grid electrode such that the focusing strengths of the correction lenses weaken with increasing deflection of the electron beams.

The first-stage electrostatic quadrupole lens is formed between the facing portions of the second member 58 and the first member 59 of the third grid electrode such that the horizontally strong focusing action is exerted on the electron beams when the electron beams are not deflected and the strength of the horizontally strong focusing action decreases with increasing deflection of the electron beams.

This structure of the electron gun increases the effective lens diameter of the main lens compared with a conventional electron gun which does not employ any intermediate electrodes such as the intermediate electrode 152 unlike the present invention, and reduces the diameter of the electron beam spots over the entire viewing screen.

At the center of the viewing screen, the second-stage electrostatic quadrupole lens which focuses the electron beams strongly in a vertical direction cancels out the astigmatism of the main lens which focuses the electron beams strongly in a horizontal direction and the first-stage electrostatic quadrupole lens which focuses the electron beams strongly in the horizontal direction cancels out the astigmatism of the second grid electrode 60 which focuses the electron beams strongly in the vertical direction, to provide approximately circular electron beam spots.

At the periphery of the viewing screen, the focusing actions of the first-stage and second-stage electrostatic quadrupole lenses weaken and consequently the astigmatism of the main lens which focuses more strongly in a horizontal direction than in a vertical direction cancels out the astigmatism caused by the deflection magnetic fields which focuses more strongly in the vertical direction than in the horizontal direction.

Simultaneously with this, the focusing action of the correction lens for curvature of the image field and that of the main lens weaken to lengthen the focal length such that focusing of the electron beams are optimized even at the periphery of the viewing screen. This effect by the correction lens for curvature of the image field makes possible the reduction of the required magnitude of a dynamic voltage, and suppresses the increase in the dynamic voltage due to the increase in the maximum deflection angle.

Figure 9:
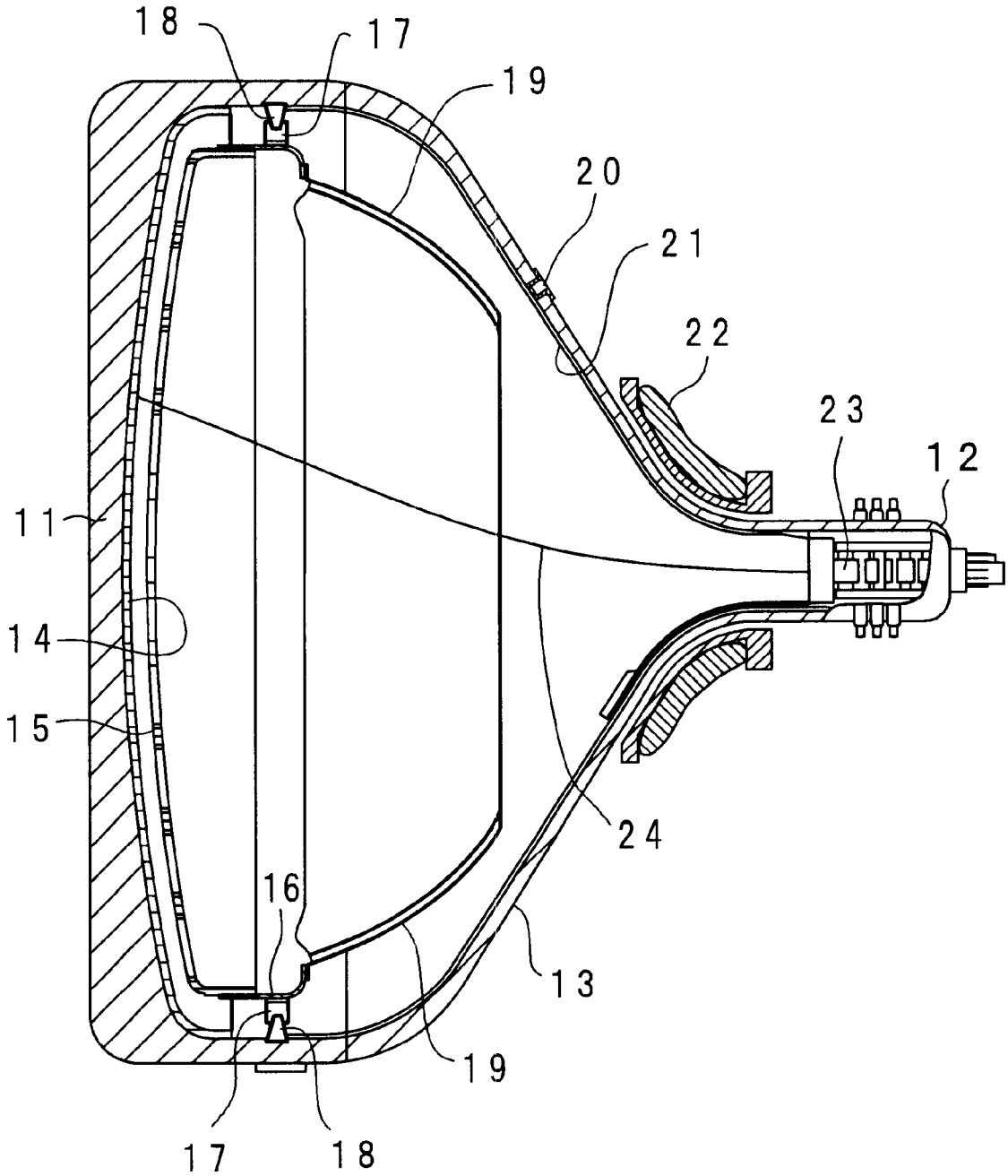
FIG. 9 is an axial cross-sectional view of an overall structure of a color cathode ray tube as an embodiment of a cathode ray tube employing an electron gun incorporating a compound electrode of the present invention.
Figure 10:
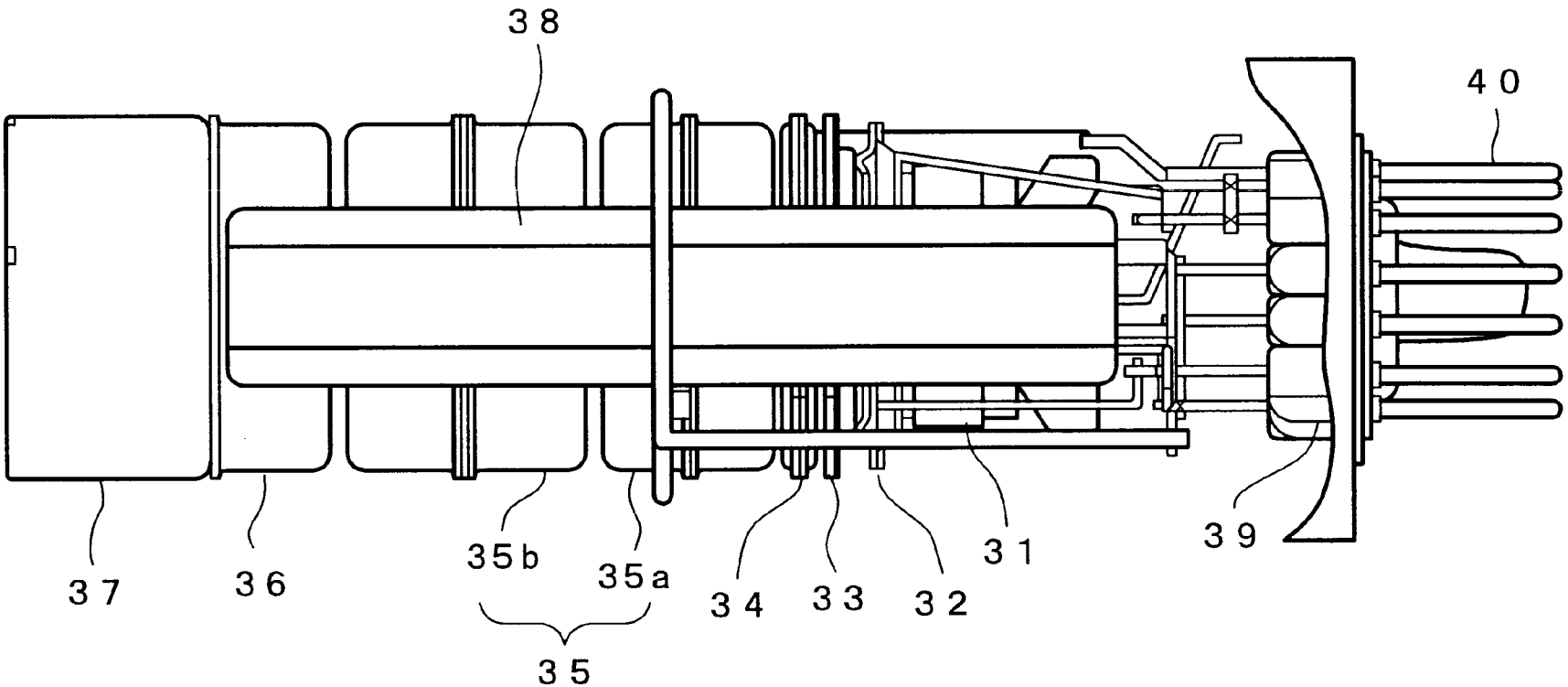
FIG. 10 is a side view of an essential part of an exemplary configuration of an in-line type electron gun used for a color cathode ray tube.
Figure 12A:
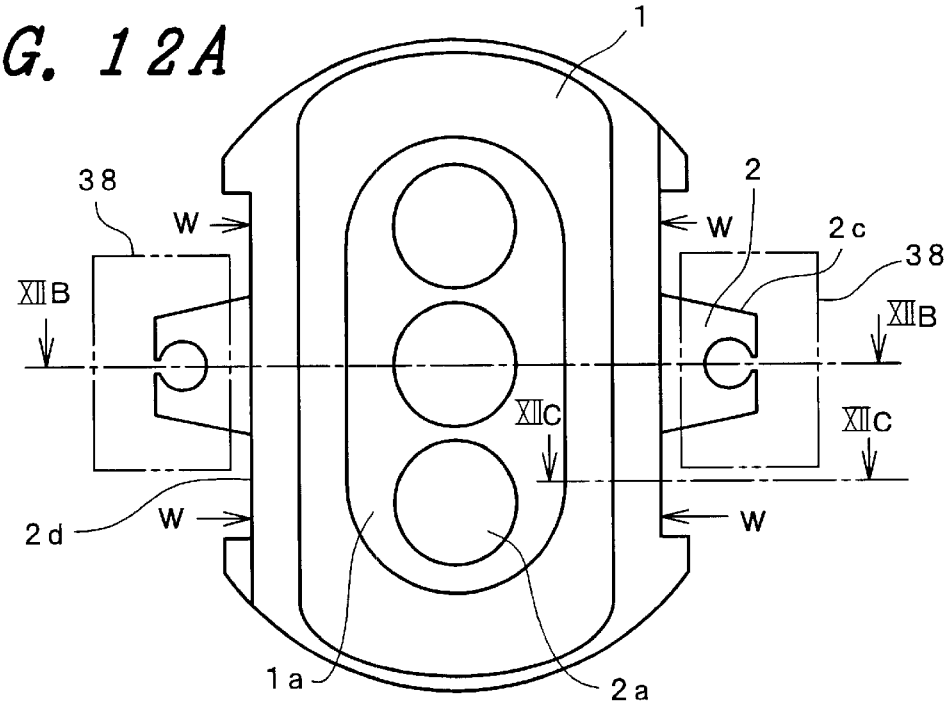
FIGS. 12A–12C are illustrations of an integrally assembled compound electrode comprised of the first, second and third electrode members of FIGS. 11B1–11C2 for explaining welding conditions, FIG. 12A being a plan view of the compound electrode, FIG. 12B being a cross-sectional view of the compound electrode of FIG. 12A taken along line XIIB—XIIB of FIG. 12A, and FIG. 12C being an enlarged fragmentary cross-sectional view of the compound electrode of FIG. 12A taken along line XIIC—XIIC of FIG. 12A.
Figure 12B:
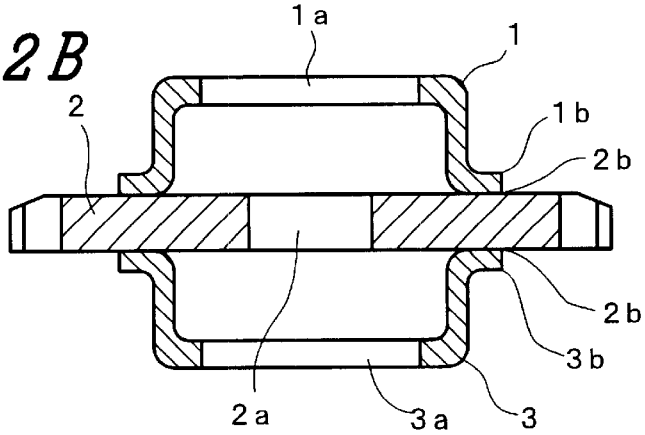
Figure 12C:
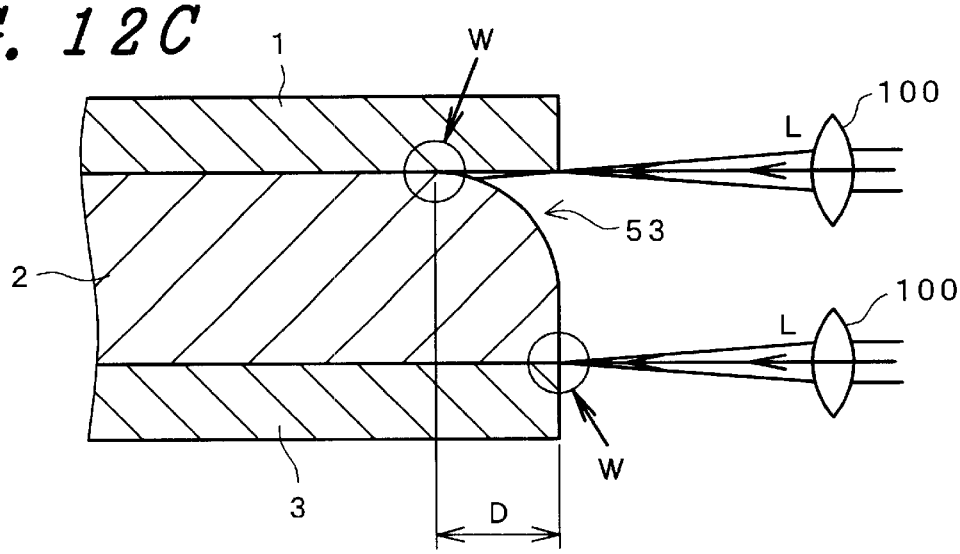
Figure 12D:
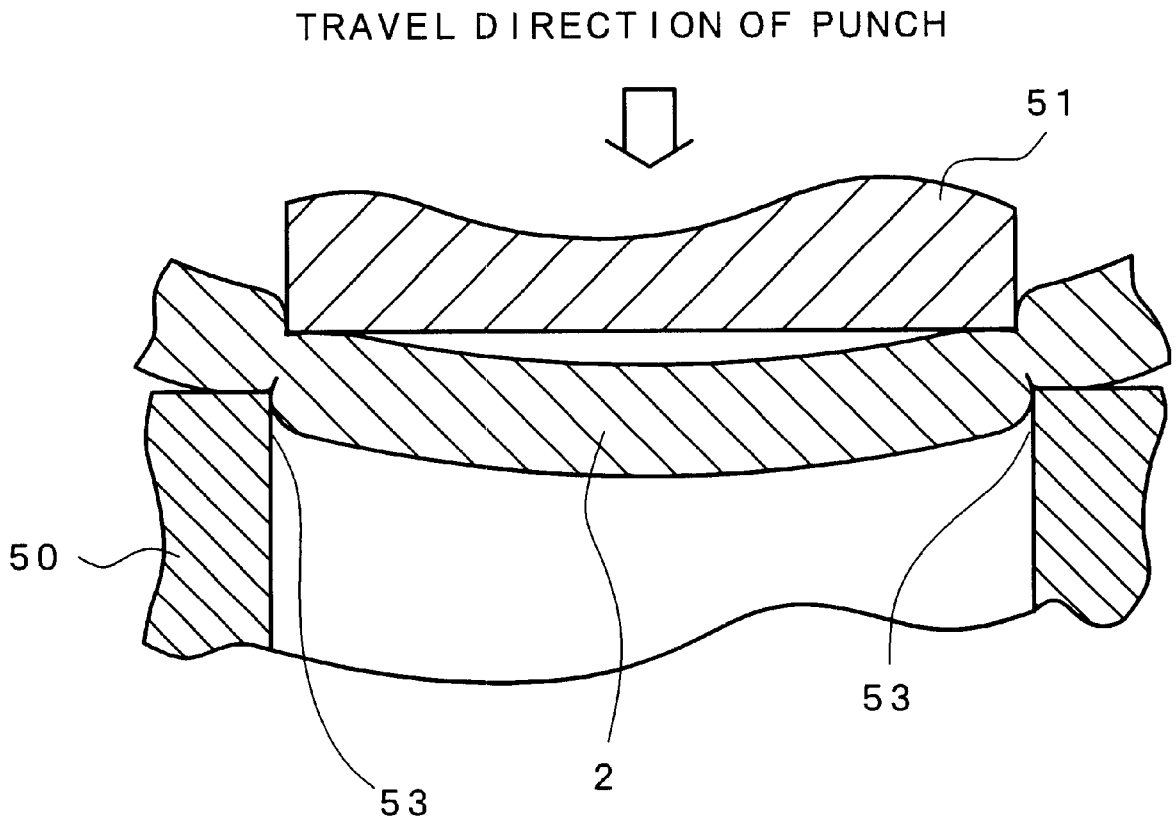
FIG. 12D is a cross-sectional view of a die, a punch and a material in the process of punching out an electrode member from the material for explaining occurrence of shear droop.

FIG. 9 is an axial cross-sectional view of an overall structure of a color cathode ray tube as an embodiment of a cathode ray tube employing an electron gun incorporating a compound electrode of the present invention. This color cathode ray tube is of the so-called flat panel type, reference numeral 11 denotes a panel portion having a generally flat surface, 12 is a neck portion, 13 is a funnel portion, 14 is a phosphor screen, 15 is a color selection electrode serving as a shadow mask, 16 is a mask frame for supporting the shadow mask 15, 17 are shadow mask suspension mechanisms, 18 are studs embedded in the inner wall of the skirt of the panel portion 11, 19 is a magnetic shield, 20 is an anode button, 21 is an internal conductive coating, 22 is a deflection yoke, 23 is an in-line type electron gun, and 24 are three electron beams (only one of which is shown).

In this color cathode ray tube, a vacuum envelope is formed of a panel portion 11, a neck portion 12 and a funnel portion for connecting the panel portion 11 and the neck portion 12, and the junction of the panel portion 11 and the neck portion 12 is wound tightly with a tensioned implosion-prevention band (not shown).

Formed on the inner surface of the panel portion 11 is the phosphor screen (a viewing screen) 14 formed of three-color phosphor elements of red, green and blue coated in stripes or dots.

The in-line type electron gun 23 housed within the neck portion 12 is comprised of a plurality of electrodes including a compound electrode comprised of a plate-like electrode member and two cup-shaped electrode members welded integrally and having one of the configurations of the above-explained embodiments.

The in-line type electron gun 23 projects three electron beams 24 in line. The shadow mask 15 serving as a color selection electrode has a multiplicity of apertures or a parallel grid array of narrow strips, is closely spaced from the phosphor screen 14 within the panel portion 11 and transmits the three electron beams 24 to the phosphor elements of their intended colors forming the phosphor screen 14 after the three electron beams 24 are deflected horizontally and vertically by the deflection yoke 22.

In this color cathode ray tube, the electrodes of the electron gun are arranged with higher precision than in conventional color cathode ray tubes, and thereby accelerating and focusing characteristics do not vary in operation of the color cathode ray tube, good focus is obtained, and consequently this color cathode ray tube displays a high-resolution color image free from variations in performance characteristics due to aging.

The present invention is not limited to color cathode ray tubes as described above, but is also equally applicable to a direct-view cathode ray tube employing a single beam and other kinds of cathode ray tubes.

As explained above, the present invention improves welding accuracy of an electrode fabricated by welding integrally assembled a plurality of electrode members including an electrode member having shear droop at its welding positions and enhances reliability of a cathode ray tube employing an electron gun incorporating such an electrode greatly and provides a high-performance and long-life cathode ray tube.

What is claimed is:

1. A cathode ray tube comprising an evacuated envelope including a panel portion, a neck portion and a funnel portion for connecting said panel portion and said neck portion, a phosphor screen formed on an inner surface of said panel portion, and an electron gun housed in said neck portion;

said electron gun comprising an electron beam generating section having a cathode, an electron beam control electrode and an accelerating electrode arranged in the order named for projecting an electron beam toward said phosphor screen, and an electron beam focusing section for focusing said electron beam from said electron beam generating section onto said phosphor screen, said electron beam generating section and said electron beam focusing section being mounted in predetermined spaced relationship on a plurality of insulator support rods, said electron beam focusing section including at least one compound electrode comprising a first electrode member, a second electrode member and a plate-like electrode member sandwiched therebetween, said plate-like electrode member being fabricated from a material thicker than materials from which said first electrode member and said second electrode member are fabricated, said plate-like electrode member being laser-welded to said first and second electrode members at points of edges of said first and second electrode members, said points of edges of said first and second electrode members being positioned so as not to face mounting tabs of said plate-like electrode member embedded in said plurality of insulator support rods, and edges of said plate-like electrode member extending by an approximately equal distance outwardly beyond said points of edges of said first and second electrode members welded to said plate-like electrode member.

2. A cathode ray tube according to claim 1, wherein at least one of said first and second electrode members is of a shape of a cup having a flange at an open end thereof and edges of said flange are laser-welded to said plate-like electrode member.

3. A cathode ray tube according to claim 1, wherein said plate-like electrode member is fabricated from a material having a thickness of at least 0.5 mm.

4. A cathode ray tube according to claim 1, wherein said approximately equal distance is equal to or less than 0.3 mm.

5. A cathode ray tube comprising an evacuated envelope including a panel portion, a neck portion and a funnel portion for connecting said panel portion and said neck portion, a phosphor screen formed on an inner surface of said panel portion, and an electron gun housed in said neck portion;

said electron gun comprising an electron beam generating section having a cathode, an electron beam control electrode and an accelerating electrode arranged in the order named for projecting an electron beam toward said phosphor screen, and an electron beam focusing section for focusing said electron beam from said electron beam generating section onto said phosphor screen, said electron beam generating section and said electron beam focusing section being mounted in predetermined spaced relationship on a plurality of insulator support rods, said electron beam focusing section including at least one compound electrode comprising a first cup-shaped electrode member having a flange at a open end thereof, a second cup-shaped electrode member having a flange at an open end thereof and a plate-like electrode member sandwiched therebetween, said plate-like electrode member being fabricated from a material thicker than materials from which said first cup-shaped electrode member and said second cup-shaped electrode member are fabricated, said plate-like electrode member being laser-welded to said first and second cup-shaped electrode members at points of edges of said flanges of said first and second cup-shaped electrode members, said points of edges of said flanges of said first and second cup-shaped electrode members being positioned so as not to face mounting tabs of said plate-like electrode member embedded in said plurality of insulator support rods, and edges of said plate-like electrode member extending by an approximately equal distance outwardly beyond said points of edges of said flanges of said first and second cup-shaped electrode members welded to said plate-like electrode member.

6. A cathode ray tube according to claim 5, wherein said plate-like electrode member is fabricated from a material having a thickness of at least 0.5 mm.

7. A cathode ray tube according to claim 5, wherein said approximately equal distance is equal to or less than 0.3 mm.

8. A cathode ray tube comprising an evacuated envelope including a panel portion, a neck portion and a funnel portion for connecting said panel portion and said neck portion, a phosphor screen formed on an inner surface of said panel portion, and an electron gun housed in said neck portion;

said electron gun comprising an electron beam generating section having a cathode, an electron beam control electrode and an accelerating electrode arranged in the order named for projecting an electron beam toward said phosphor screen, and an electron beam focusing section for focusing said electron beam from said electron beam generating section onto said phosphor screen, said electron beam generating section and said electron beam focusing section being mounted in predetermined spaced relationship on a plurality of insulator support rods, said electron beam focusing section including a focus electrode, a compound electrode and an anode supplied with a highest voltage, arranged in the order named toward said phosphor screen, said compound electrode supplied with an intermediate voltage between said highest voltage and a voltage supplied to said focus electrode, said intermediate voltage being obtained by dividing said highest voltage via a resistor housed in said cathode ray tube, said compound electrode comprising a first cup-shaped electrode member having a flange at an open end thereof, a second cup-shaped electrode member having a flange at an open end thereof and a plate-like electrode member sandwiched therebetween, said plate-like electrode member being fabricated from a material thicker than materials from which said first cup-shaped electrode member and said second cup-shaped electrode member are fabricated, said plate-like electrode member being laser-welded to said first and second cup-shaped electrode members at points of edges of said flanges of said first and second cup-shaped electrode members, said points of edges of said flanges of said first and second cup-shaped electrode member being positioned so as not to face mounting tabs of said plate-like electrode member embedded in said plurality of insulator support rods, and edges of said plate-like electrode member extending by an approximately equal distance outwardly beyond said points of edges of said flanges of said first and second cup-shaped electrode members welded to said plate-like electrode member.

9. A cathode ray tube according to claim 8, wherein said plate-like electrode member is fabricated from a material having a thickness of at least 0.5 mm.

10. A cathode ray tube according to claim 8, wherein said approximately equal distance is equal to or less than 0.3 mm.

11. A cathode ray tube comprising an evacuated envelope including a panel portion, a neck portion and a funnel portion for connecting said panel portion and said neck portion, a phosphor screen formed on an inner surface of said panel portion, and an electron gun housed in said neck portion;

said electron gun comprising an electron beam generating section having a cathode, an electron beam control electrode and an accelerating electrode arranged in the order named for projecting an electron beam toward said phosphor screen, and an electron beam focusing section for focusing said electron beam from said electron beam generating section onto said phosphor screen, said electron beam generating section and said electron beam focusing section being mounted in predetermined spaced relationship on a plurality of insulator support rods, said electron beam focusing section including at least one compound electrode comprising a first electrode member, a second electrode member and a plate-like electrode member sandwiched therebetween, said plate-like electrode member being fabricated from a material thicker than materials from which said first electrode member and said second electrode member are fabricated, said first electrode member being stacked on a surface of said plate-like electrode member having shear droop caused in punching out said plate-like electrode member, said second electrode member being formed with cutouts at edges thereof, said plate-like electrode member being laser-welded to said second electrode member and said first electrode member at said cutouts of said second electrode member and points of edges of said first electrode member corresponding to said cutouts of said second electrode member, respectively, said cutouts of said second electrode member and said points of edges of said first electrode member being positioned so as not to face mounting tabs of said plate-like electrode member embedded in said plurality of insulator support rods.

12. A cathode ray tube according to claim 11, wherein at least one of said first and second electrode members is of a shape of a cup having a flange at an open end thereof and edges of said flange are laser-welded to said plate-like electrode member.

13. A cathode ray tube according to claim 11, wherein said plate-like electrode member is fabricated from a material having a thickness of at least 0.5 mm.

* * * * *